US005785012A

United States Patent [19]

Parsons et al.

[11] Patent Number: 5,785,012

[45] Date of Patent: Jul. 28, 1998

[54] ACOUSTICALLY ENHANCED COMBUSTION METHOD AND APPARATUS

[75] Inventors: Jim Parsons, Kearney, Mo.; James Joseph Schwab, Napa, Calif.; Marlin H. Anderson, Hopkinsville, Ky.

[73] Assignee: BHA Group Holdings, Inc., Kansas City, Mo.

[21] Appl. No.: 454,256

[22] PCT Filed: Dec. 15, 1992

[86] PCT No.: PCT/US92/10843

§ 371 Date: Mar. 11, 1996

§ 102(e) Date: Mar. 11, 1996

[87] PCT Pub. No.: WO94/14003

PCT Pub. Date: Jun. 23, 1994

[51] Int. Cl.[6] ..... F22B 15/00; F22B 25/00; F22B 37/10

[52] U.S. Cl. ..... 122/235.11; 122/6 A; 431/1; 431/2

[58] Field of Search ..... 431/1, 2; 110/297, 110/309, 347; 122/235.11, 6 A

[56] References Cited

U.S. PATENT DOCUMENTS

| | | | |
|---|---|---|---|
| 3,233,597 | 2/1966 | Svendsen | 122/235.11 |
| 3,586,468 | 6/1971 | Sims et al. . | |
| 3,603,145 | 9/1971 | Morris | 73/155 |
| 3,796,536 | 3/1974 | Hori et al. . | |
| 3,885,902 | 5/1975 | Fujieda et al. . | |
| 3,941,552 | 3/1976 | Cottell . | |
| 4,153,201 | 5/1979 | Berger et al. . | |
| 4,165,961 | 8/1979 | Yamamoto et al. . | |
| 4,394,849 | 7/1983 | Pratt | 122/6 A |
| 4,608,013 | 8/1986 | Gaysert et al. . | |
| 4,635,571 | 1/1987 | Olsson et al. | 110/297 |
| 4,650,413 | 3/1987 | Olsson et al. . | |
| 5,020,479 | 6/1991 | Suesada et al. | 122/235.11 |
| 5,370,771 | 12/1994 | Nilsson | 431/1 |

FOREIGN PATENT DOCUMENTS

| | | |
|---|---|---|
| 54-104038 | 8/1979 | Japan . |
| 59-115910 | 4/1984 | Japan . |

*Primary Examiner*—Henry A. Bennett
*Assistant Examiner*—Jiping Lu
*Attorney, Agent, or Firm*—Kokjer, Kircher, Bowman & Johnson

[57] ABSTRACT

A method and apparatus are provided for enhancing the efficiency of combustion in a combustion chamber with the use of acoustic energy. A means for generating acoustic energy (34) is located in relation to a combustion chamber (12) such that acoustic energy is transmitted into the combustion chamber (12) resulting in excitation of particulate and gases flowing therein and increased combustion efficiency. In the preferred embodiment, increased combustion efficiency is accomplished by operation of a horn (34) located at substantially the top of the combustion chamber (12) for generating acoustic energy into the chamber (12).

6 Claims, 2 Drawing Sheets

ACOUSTICALLY ENHANCED COMBUSTION METHOD AND APPARATUS

BACKGROUND OF THE INVENTION

This invention relates generally to an improvement in the boiler combustion process and, more particularly, provides a horn for generating acoustic energy in the combustion chamber of a boiler for enhancing the combustion process.

In general, a boiler is a pressurized system for generating energy in which a liquid is vaporized to its gaseous state. Usually, water is used as the liquid and the boiler is used to change the water to steam. Boiling of the water to create steam is accomplished by transferring heat from a source of high temperature to the water.

The source of high temperature in the boiler for heating the water is usually the product of combustion from burning fuels. Combustion, generally defined as the burning of any substance, creates heat and often light. The heat from combustion is transferred to the water which boils and emits steam.

The steam generated by the boiler may then be utilized as a source of energy to be used for various purposes. Common uses of the steam include heating and driving machinery to perform mechanical work, which may in turn be converted into electrical energy.

The efficiency of boiler operation is greatly dependent upon the efficiency of combustion occurring in the combustion chamber of the boiler. Combustion efficiency depends on a variety of factors such as the air pressure in the combustion chamber and the precise mixture of air and fuel utilized in the combustion process. In general, fuel is introduced into the combustion chamber and put in contact with a flame. Simultaneously, oxygen (or perhaps another oxidizing agent) is introduced into the combustion chamber. Combustion will not occur without oxygen or another type of oxidizing agent, such as oxygen, coming into contact with the fuel.

The primary goals of boiler operation and combustion are to minimize fuel consumption while maximizing combustion efficiency and boiler heat output. An additional goal is to minimize the amount of pollution resulting from the combustion process. Certainly, leaving any portion of fuel unburned is inefficient and undesirable. To maximize combustion efficiency, it is desirable to completely combust each molecule of fuel while using the minimum amount of oxygen possible to accomplish complete combustion. Additionally, any oxygen in the system in excess of that required for combustion can combine with Nitrogen to form Nitrous Oxide ($NO_x$), a pollutant.

Moreover, combustion produces ash, commonly known as fly ash. Fly ash, a by-product of the fuel, may contain carbon that was not totally burned. It is desirable to maintain the lowest possible percentage of carbon in the fly ash, which indicates the highest combustion efficiency. The acoustics of the present invention aid in stripping previously reacted sites on fly ash to make them ready for additional reaction (i.e., combustion). This process is repeated while the particulate being reacted upon remains within the combustion chamber. Since it has been found through experimentation that acoustics generated in the top of a combustion chamber in accordance with the present invention carry all the way to the bottom of the combustion chamber without losing substantial sound pressure level, the present invention advantageously repeatedly strips fly ash from its reacted state to a reactive state throughout the entire residence time of the particle upon which reaction is occurring.

The present invention utilizes acoustic energy to enhance the combustion process. By directing acoustic waves into the combustion chamber during combustion, gases and particulate in the chamber are excited and reaction between fuel and oxygen is accomplished more completely, more frequently, and more quickly. Moreover, test results indicate that the residence time of particulate is increased by operation of the present invention. As a result, more time is available for reaction during combustion to occur.

Attempts have been made in the past to utilize acoustic waves for enhancing the combustion process. For instance, U.S. Pat. No. 4,655,146 shows a tuned combustion chamber for generating a resonant frequency to increase combustion efficiency. However, such prior art devices are cumbersome and expensive to manufacture and operate.

SUMMARY OF THE INVENTION

The present invention is directed to a simple, inexpensive and easy-to-use device for enhancing combustion by increasing the burning efficiency of fuel used during combustion and by minimizing pollution resulting from the combustion process. These goals are achieved by directing acoustic waves into the combustion chamber during the combustion process. In the preferred embodiment of the present invention, a combustion chamber of a boiler is provided having an aperture in the top wall of the combustion chamber. A horn for generating acoustic energy is positioned with respect to the aperture for directing acoustic waves into the combustion chamber. It has been found that applying acoustic waves into the combustion chamber during combustion substantially increases combustion efficiency and reduces the amount of fly ash and the carbonic content of the fly ash, and also reduces $No_x$ pollutants. The introduction of acoustic waves to the combustion chamber excites the gases and particulate flowing in the chamber and causes reaction of fuel and oxygen to be significantly more efficient.

It should be understood that the present invention includes utilizing a plurality of horns. Moreover, location of one or more horns could be at any location within or near the chamber, including being mounted on the top, bottom or side walls of the chamber, or suspended within the chamber in an insulated sleeve. Additionally, the horn or horns may be blown continuously or intermittently.

Accordingly, it is a primary object of this invention to provide a new and improved highly efficient boiler and combustion system, apparatus and method.

It is also an object of this invention to provide a boiler system and combustion method and apparatus in which pollution therefrom is low.

It is also an object of this invention to provide a boiler system and combustion method and apparatus in which fly ash and Nitrous Oxide are significantly reduced.

It is also an object of this invention to provide a boiler system and combustion method and apparatus in which the carbonic content of fly ash produced from combustion is low.

It is a further object of this invention to provide a boiler system and combustion method and apparatus in which unburned fuel is minimized.

It is still another object of this invention to provide a boiler system and combustion method and apparatus in which acoustic energy is directed into the combustion chamber for enhancing boiler and combustion efficiency.

It is also an object of this invention to provide an apparatus and for combusting fuel in which at least one horn is located on or near the combustion chamber of a boiler for directing acoustic energy into the combustion chamber.

Other objects, advantages and features of this invention, together with the features of novelty appurtenant thereto, will appear in the course of the following description.

DETAILED DESCRIPTION OF THE INVENTION

Figure 1:
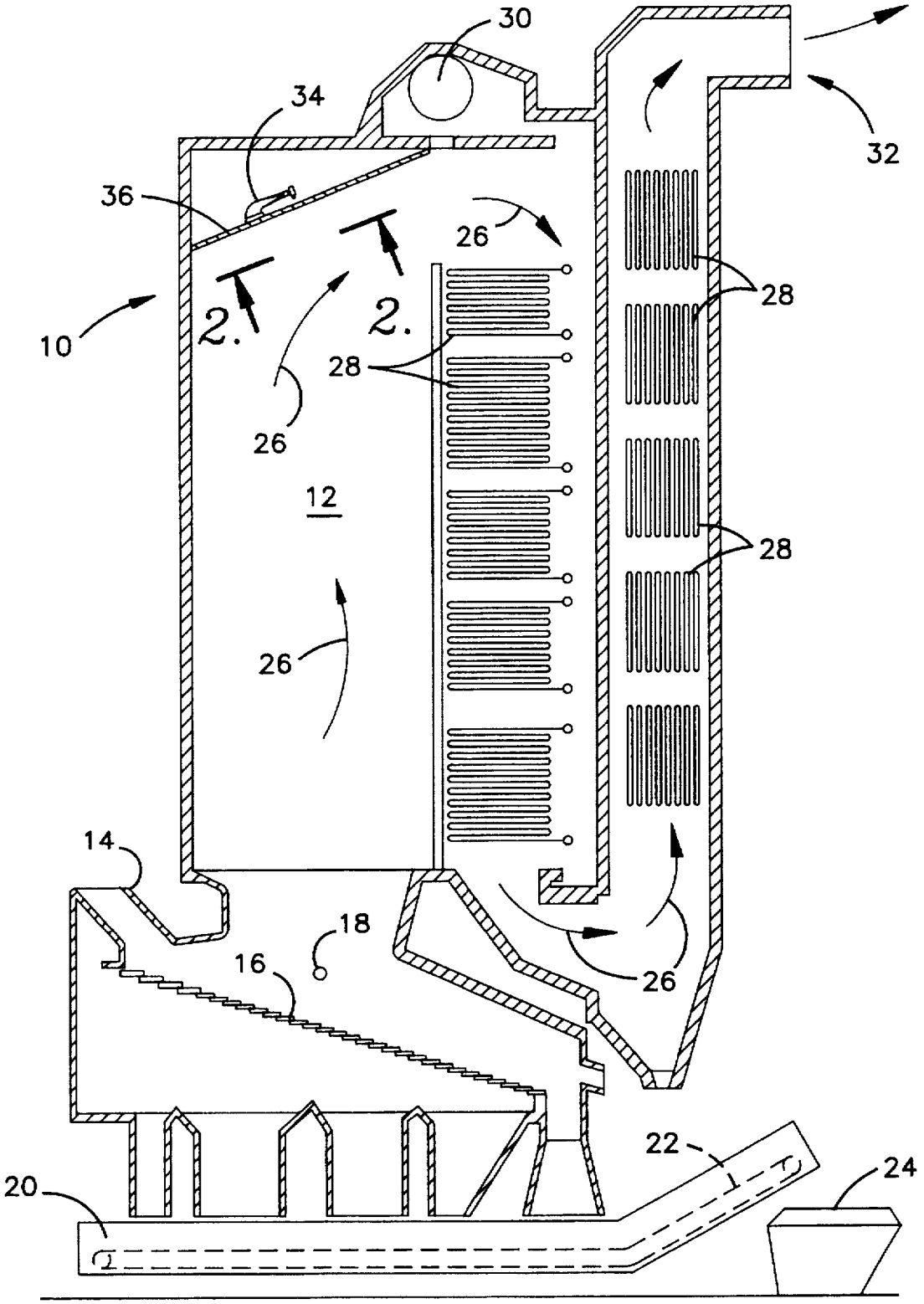
FIG. 1 is a side sectional view of a combustion boiler showing the preferred embodiment of the present invention including a horn located on the top wall of the combustion chamber of the boiler system.

With reference to FIG. 1, a combustion boiler system in accordance with the preferred embodiment of the present invention is generally denoted by numeral 10. Boiler 10 comprises a combustion chamber 12 which operates like a furnace. Fuel is fed into boiler 10 at fuel inlet 14. Various types of liquid and solid fuel are known to be used. Coal and tires are common fuel choices. The fuel cascades down stoker grates 16 while being exposed to flame from burner 18. Oxygen or another oxidizing agent is also controllably introduced into combustion chamber 12 in any one of various manners commonly known.

A water bath 20 is located beneath stoker grates 16 for catching and cooling any fuel, ashes or particulate dropping from stoker grates 16. A conveyor 22 transports the material dropping into water bath 20 to a container 24 so that the material may be further used or appropriately discarded. It should be understood that the present invention is shown utilized on a stoker fired boiler only for illustrative purposes and that other boiler-types may be employed with the present invention.

Arrows 26 indicate the general directional flow of gases and particulate in boiler 10. A plurality of tube bundles 28 are located along the interior wall of boiler 10. Tube bundles 28 constitute the conductive section of boiler 10. Heat from combustion in chamber 12 passes over tube bundles 28 which have water flowing through them. The heat causes the water to boil and generate steam. Steam and water are gathered by steam drum 30 (connection not shown). The steam is then used for any desired purpose such as heating or driving mechanical equipment, which may in turn generate electrical energy. Gases and particulate then exit boiler 10 at outlet 32. Outlet 32 may be connected with a baghouse, precipitator or other means for filtering the gases prior to their discharge into the atmosphere.

The present invention resides in directing acoustic waves into combustion chamber 12 for enhancing combustion. More specifically, a horn or other means for generating acoustics is used for directing acoustics to combustion chamber 12. In the preferred embodiment of the present invention, a horn 34 is located on top of combustion chamber 12 in relation to an aperture cut into the top wall 36 of combustion chamber 12. The horn is preferably one of a type AH Series as manufactured by BHA Group, Inc. of Kansas City, Mo. Although it is to be understood that the present invention contemplates the use of any frequency, the horn preferably utilized with the present invention is capable of generating a low frequency output in the range of 100–500 cycles per second (Hz) while maintaining a minimum of 128 decibels (dB) at the fundamental frequency generated.

In operation, horn 34 emits acoustic waves into combustion chamber 12. The waves excite the particulate ash and gases in chamber 12 causing them to move more rapidly and enhancing mixing and reaction of particulate and gases.

It should be understood that one or more horns 34 may be used in conjunction with the present invention. Additionally, while the preferred location of the horn is at or near the top of combustion chamber 12, one or more horns may be located at any location in combustion chamber 12 or along the top, bottom or side walls of combustion chamber 12. Also, it is preferred to operate the horn in a continuous fashion, but operation of the horn intermittently or at various intervals is also contemplated and within the scope of the present invention. It should be understood that the generation of acoustic waves in the combustion chamber can be accomplished by means other than a horn. For instance, any device of generating sound or frequency could be used, including but not limited to, an electronic sound generator, perhaps coupled with speakers and amplifiers located in, on, or near the combustion chamber.

Figure 2:
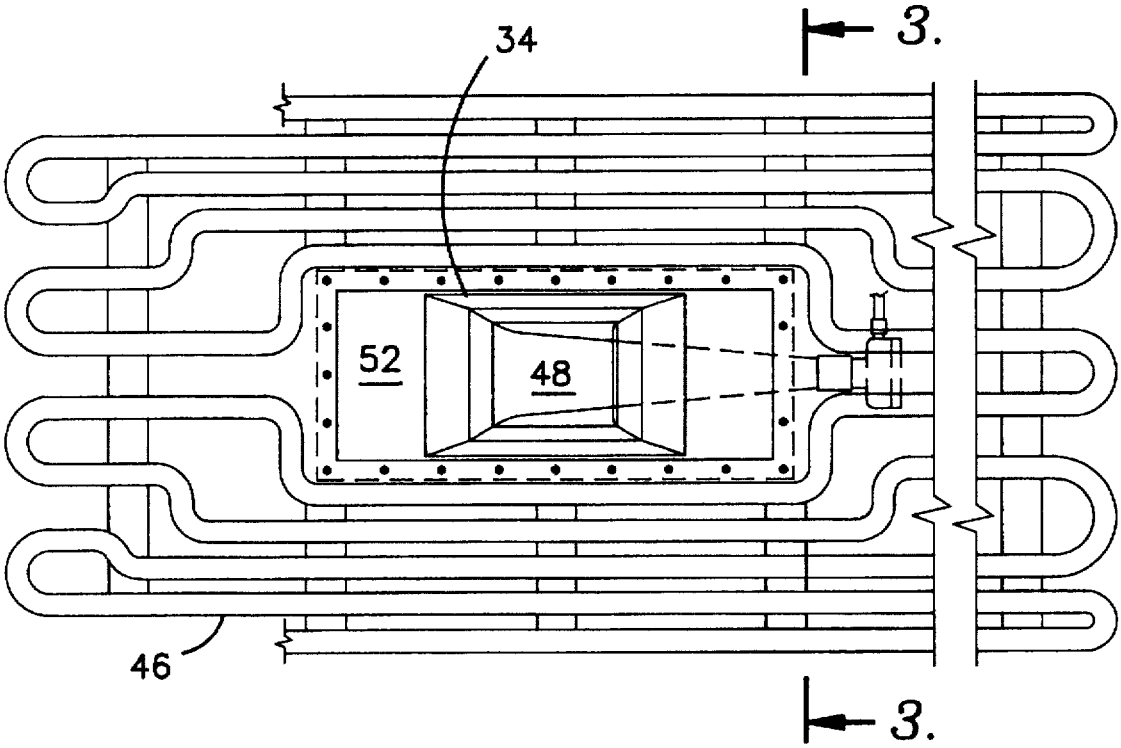
FIG. 2 is a view from inside the combustion chamber of the top wall of the combustion chamber of the preferred form of the present invention taken along line 2—2 of FIG. 1.
Figure 3:
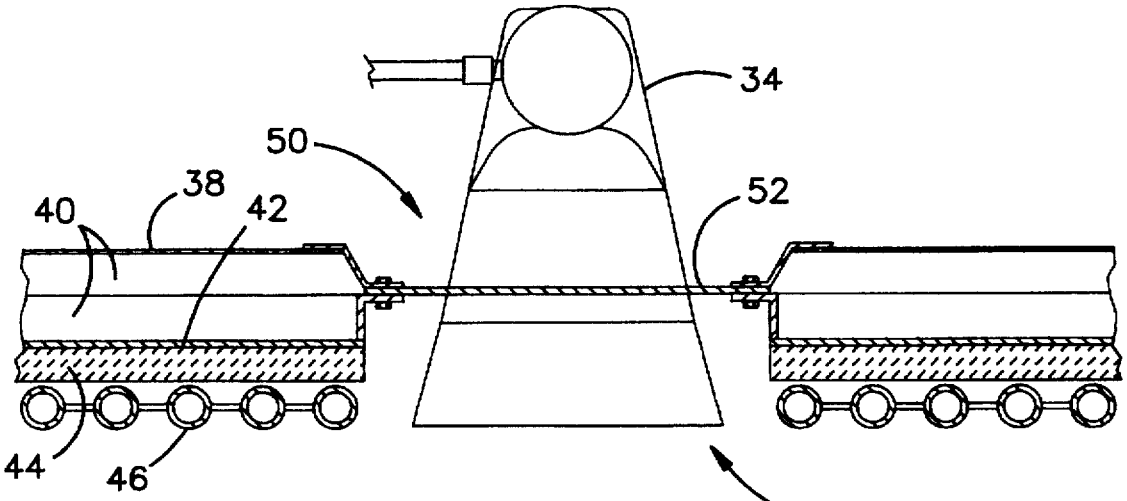
FIG. 3 is a cross-sectional view of the top wall of the combustion chamber of the preferred embodiment of the present invention taken along line 3—3 of FIG. 2.

Referring now to FIGS. 2 and 3, mounting and positioning of horn 34 is described. As seen in FIG. 3, a cross-section of the top wall 36 of chamber 12 is shown in detail. All walls, including top wall 36, of chamber 12 preferably have an outer layer 38 of corrugated lagging. Beneath lagging 38 is insulation 40. A metallic sheet 42 covers a layer of refractory brick 44. Along the inner-most wall of the chamber 12 are water tube walls 46 for cooling the walls of chamber 12.

Horn 34 is positioned relative to an aperture 50 which is cut in the wall of chamber 12. Specifically, aperture 50 requires forming a hole through each layer of the chamber wall, including the water tube walls 46. As seen in FIG. 2, water tube walls 46 are generally in the form of sections of a continuous tube which routes water back and forth across a particular section of the wall of chamber 12 for cooling that area of the chamber wall. As a result, the tubing 46 is not actually cut during formation of aperture 50, but rather the tubing is designed around aperture 50 in the chamber wall for receiving the mouth portion 48 of horn 34. In the preferred embodiment, a plate 52 is also preferably bolted or riveted within aperture 50. Plate 52 has a central aperture for receiving the mouth portion 48 of horn 34.

It should be understood that the manner in which aperture 50 is created is not crucial to this invention. Aperture 50 can be formed in an existing chamber 12 or can be part of design plans of chambers to be constructed. In other words, the present invention can be retrofit onto existing combustion chambers.

In an alternative embodiment (not shown), one or more horns 34 or other type of sound generating devices are suspended in chamber 12. Suspension is preferably from a cable attached at its upper end to an upper portion of chamber 12, but horn 34 could be suspended in other manners. Additionally, each horn 34 could be covered with an insulating sleeve to protect the horn from damage during combustion.

Testing of the device of the present invention has shown that the quantity of fly ash is reduced by as much as 40% when the present invention is used during the combustion process. Moreover, it has been found that the loss-on-ignition (LOI), which is the amount of carbon in the ash, is reduced from 70% down to 5% which is indicative of more complete combustion. Moreover, fuel consumption has been decreased by as much as 7% without a loss in heat output.

By testing and recording the power rating of the horn in operation at various points in chamber 12 while boiler 10 was not in operation and no combustion was occurring in chamber 12, it was found that the decibel (dB) reading does not significantly vary at different points within the chamber when the horn 34 is located at or near the top of chamber 12. It was found that this uniformity of sound pressure level within chamber 12 was not altered at the boundaries of the chamber 12 when the same test was performed during operation of boiler 10 with combustion occurring within chamber 12. Significantly, substantially the same sound pressure level readings were found during combustion as were recorded while the boiler 10 was not in use. In other words, the fire ball in the combustion chamber 12 is opaque to sound and the acoustic waves generated from horn 34 permeate all the way to the bottom of chamber 12 without any significant reduction in sound level. As a result, one of the advantages of the present invention includes increasing the excitement of particles and gases in chamber 12 thereby increasing combustion efficiency throughout the entire residence time of the gases and particles. Residence time is generally the time it takes a particle to travel from the bottom of chamber 12 to the top of chamber 12.

Finally, it has been found that the most advantageous combustion results occur when horn 34 generates a frequency of between 100 cycles per second (Hz) and 500 cycles per second (Hz) while the sound level throughout the chamber 12 is maintained at a minimum of 128 decibels (Db).

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, we claim:

1. An apparatus comprising:

a combustion chamber wherein fuels are combusted, said combustion chamber having a top wall with an aperture therein, said top wall formed of an outer layer, a layer of insulation located immediately adjacent said outer layer, a metallic sheet located immediately adjacent said insulation layer, and a layer of refractory brick located immediately adjacent said metallic sheet;

tubular water wall sections, located immediately adjacent said refractory brick layer, comprising a plurality of substantially parallel tube portions, wherein said tubular water wall sections are positioned around said aperture;

a plate, having a central opening therein, located within said aperture in said top wall; and a horn having an enlarged mouth portion, said central opening in said plate for receiving said enlarged mouth portion of said horn, said horn adapted to direct generated acoustic energy into said combustion chamber through said aperture for enhancing the efficiency of combustion occurring in said chamber.

2. The apparatus of claim 1 wherein said means for generating acoustic energy is located at substantially the top of said chamber.

3. The apparatus of claim 1 wherein said generated acoustic energy is within the frequency range of 100 to 500 cycles per second (Hz).

4. The apparatus of claim 3 wherein the sound pressure level at said generated acoustic frequency range is maintained at a minimum of 128 decibels (dB).

5. The apparatus of claim 1 wherein said means for generating acoustic energy generates an acoustic frequency intermittently.

6. The apparatus of claim 1 wherein said means for generating acoustic energy is a horn.

* * * * *